US006078128A

United States Patent [19]

Gagnon et al.

[11] Patent Number: 6,078,128

[45] Date of Patent: Jun. 20, 2000

[54] LAMP EYELET

[75] Inventors: Peter R. Gagnon; Joseph P. Gallant, both of Lexington, Ky.

[73] Assignee: Osram Sylvania Inc., Danvers, Mass.

[21] Appl. No.: 08/780,421

[22] Filed: Jan. 7, 1997

[51] Int. Cl.[7] ..... H01J 5/16; H01J 61/40; H01J 5/48; H01J 5/50

[52] U.S. Cl. ..... 313/113; 313/318.05; 313/318.11; 313/493; 313/573; 313/634; 439/615

[58] Field of Search ..... 313/318.01, 318.03, 313/318.04, 318.08, 318.06, 318.07, 318.09, 318.1, 318.11, 318.12, 493, 573, 634; 362/80, 267, 310; 439/419, 602, 615, 699.1, 874; 445/27

[56] References Cited

U.S. PATENT DOCUMENTS

| | | | |
|---|---|---|---|
| 3,775,634 | 11/1973 | Hasell et al. | 313/318.03 |
| 4,300,189 | 11/1981 | Shanks | 362/267 |
| 4,623,958 | 11/1986 | Van Der Linde et al. | 313/113 X |
| 4,855,634 | 8/1989 | Gagnon et al. | 313/113 |
| 5,003,217 | 3/1991 | Bushmann | 313/318.05 |
| 5,306,179 | 4/1994 | Korenowski | 439/615 |

FOREIGN PATENT DOCUMENTS

| | | |
|---|---|---|
| 0491432 | 6/1992 | European Pat. Off. . |
| 0780884 | 6/1997 | European Pat. Off. . |
| 2953402 | 6/1981 | Germany . |
| 2015822 | 9/1979 | United Kingdom . |

*Primary Examiner*—Nimeshkumar D. Patel
*Assistant Examiner*—Mack Haynes
*Attorney, Agent, or Firm*—William E. Meyer

[57] ABSTRACT

An electric lamp with an enclosed lamp capsule has reduced production manufacturing losses when manufactured with a split eyelet used to duct a lead through the lamp housing. The elongated tube portion of the eyelet has either thinned wall sections or splits formed along the tube axis. When the rivet is set, the tube wall distorts or gives way along the weakened axially lines. The housing glass is then not fractured during riveting, and after riveting the thermal expansion and contraction of the glass with respect to the rivet results in decreased pressure on the glass. The lamp with a split eyelet yields a higher percentage of lamps surviving the manufacturing process, and having fewer cracks or other rivet induced defects in final products.

13 Claims, 2 Drawing Sheets

LAMP EYELET

TECHNICAL FIELD

The invention relates to lamps and particularly to electric lamps. More particularly the invention is concerned with electric lamps with eyelet connections through the lamp housing.

BACKGROUND ART

For halogen PAR type lamps there is a need to rigidly fix the lamp capsule to the reflector with the filament coil in a known position relative to the focal point of the reflector. One current art method uses an insulating spacer and ceramic adhesives. An alternative method uses a metal disc in conjunction with metal eyelets that are crimped loosely to the reflector. A third alternative uses two metal eyelets crimped tightly to the reflector. The first two systems require additional parts and labor to assemble, and are therefore expensive in terms of material, and manpower. There is then a need for a low cost system to attach the capsule to the reflector.

The third system is effective and automatable, but is highly dependent on small variations in the conditions of the holes in the glass reflector. These variations result in broken glassware, or loose fitting lamp capsules. There have been occasions where glass reflectors which appeared to comply with the manufacturing specifications could not be made to run at reasonable efficiencies in automated equipment. These slight manufacturing differences are difficult, if not from a practical standpoint, impossible to control. There is then a need for a way to attach eyelets to a glass housing which is less sensitive to the normal variations in manufactured glassware than currently exists.

One attempt to improve the reliability of the eyelet riveting process used load cells to de-energize the eyelet staking tooling to achieve a consistent crimping force. While de-energizing the riveting process appears to have increased process capability, there are at times still unacceptable levels of broken glass and other operating problems. Unfortunately taking energy out of the riveting process increases the likelihood of loose eyelets. Loose eyelets allow the lamp capsule to stray from the proper focal position. As a result de-energizing the riveting process does not yield a fully satisfactory result. There is then a need for an improved lamp eyelet, and method of using it in lamp construction.

DISCLOSURE OF THE INVENTION

A lamp may be constructed resulting in less material waste using an improved eyelet. The lamp comprises a lamp capsule having two extending input leads, a lamp housing enclosing the lamp capsule, the housing having at least one housing wall defining a through passage to receive an electrical coupling for at least one of the lamp leads, an eyelet located in the through passage and locked to the lamp housing, the eyelet having a tube having a metal wall, a first end, a second end, an axis extending from the first end to the second end, a wall thickness, and at least one axially extending thin wall portion, an inside diameter, a portion of the thin walled portion being bowed outward to press against the housing wall, and a flange, extending radially from the first end of the tube, the flange positioned adjacent the housing wall, an input lead passing through the tube, and mechanically coupled to the tube to lock the lead in place with reference to the eyelet, and an electrical coupling receiving the electrical leads for electrical connection to an electrical supply.

BEST MODE FOR CARRYING OUT THE INVENTION

Figure 1:
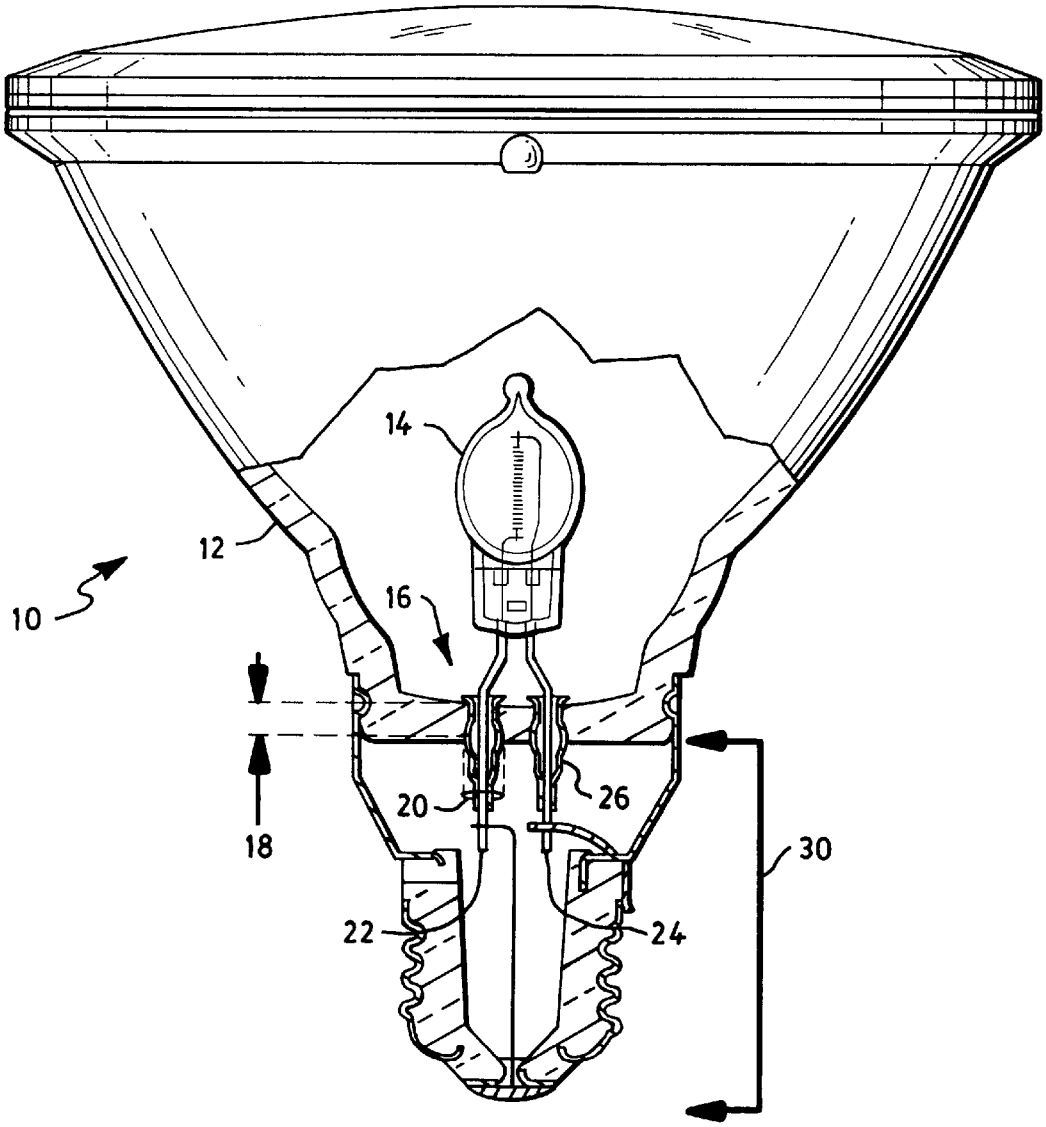
FIG. 1 shows a cross sectional view of a preferred embodiment of a lamp using eyelets.
Figure 2:
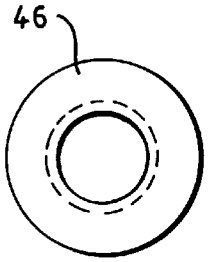
FIG. 2 shows an end view of a lamp eyelet.
Figure 3:
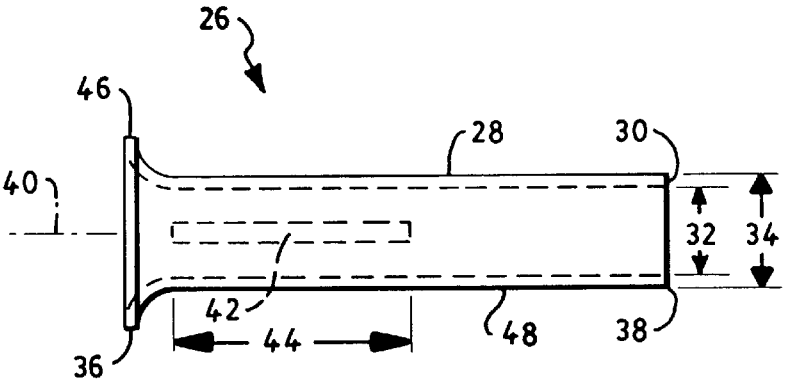
FIG. 3 shows a side view of a lamp eyelet.
Figure 4:
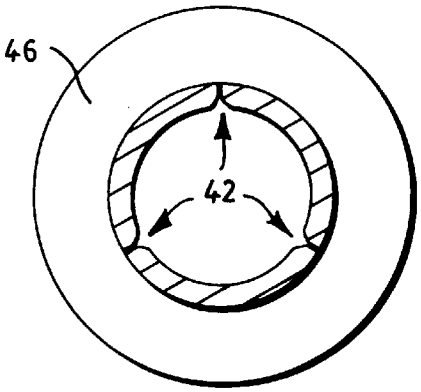
FIG. 4 shows a cross sectional view of a preferred lamp eyelet.

FIG. 1 shows a cross sectional view of a preferred embodiment of a lamp using eyelets. Like reference numbers designate like or corresponding parts throughout the drawings and specification. The completed lamp 10 includes a lamp housing 12, lamp capsule 14, eyelets 26, and an electric coupling 30. The lamp eyelet 26 is assembled as a tube 28 with a flared end forming a flange 46, with thinned walled sections 42.

The lamp housing 12 may be made out of glass to have the general form of a concave enclosure for a lamp capsule 14. The lamp housing 12 has a wall defining the enclosure and also defining at least one passage 16 with a passage length 18, and a passage diameter 20. Reflective parabolic, elliptical and other reflector forms are known in the lamp art. By way of example lamp housing 12 is shown as a single piece PAR lamp reflector with a lens cover, although it may be of any other suitable configuration.

The lamp capsule 14 may be made out of glass envelope to have the general form of a tube, sphere or other typical envelope shape. The lamp capsule 14 encloses in the envelope a light source that is coupled through the envelope to two or more electric leads 22, 24. The light source, for example, may be a tungsten halogen filament, or an arc lamp. The electric leads 22, 24 provide mechanical support for the lamp capsule 14 and supply electric power to the light source. The preferred electric leads 22, 24 are nickel plated steel wires. By way of example, lamp capsule 14 is shown as a single ended, press sealed tungsten halogen lamp capsule although it may be of any other suitable configuration.

The eyelet 26 may be made out of 80/20 brass to have the general form of a flared tube. The tube 28 has a metal wall 30 with an inside diameter 32 and an outside diameter 34 defining a thickness therebetween. The passage diameter 20 is somewhat larger than the outside diameter 34. The tube 28 has a first end 36 and a second end 38 and an axis 40 extending therebetween. The tube's axial length is greater than the passage length 18. The metal wall 30 has a thickness sufficient to provide a rigid coupling to the lamp housing 12, but thin enough to provide practical bending in the riveting process to the conform to, but not to fracture the glass lamp housing 12 or reflector. The preferred metal wall 30 is made of a malleable brass, although the Applicants believe aluminum will provide an equivalent function at less cost. Positioned along tube 28 is at least one axially extending thin wall portion 42. The thin wall portion 42 can be formed as a groove pressed or cut into the metal wall 30. The depth of the thin wall portion 42 should be sufficient to encourage mechanical distortion or failure of the metal wall 30 along the thin walled portion 42. The thin wall portion 42 may even be so deep as to penetrate or cut through the whole depth of the metal wall 30. The preferred thin wall portion 42 has depth about eighteen percent or greater of the thickness of the metal wall 30. There may be more than one thin wall portion 42. With multiple grooves or slits, the eyelet 26 is less likely to over stress any particular point along the inside of the formed passage 16. In the preferred embodiment there are three grooves located around the inside wall of the eyelet 26 at about 120 degrees apart from each other. The thin wall sections 42 may extend from the first end 36 to the second end 38, but it is believed that such a form is likely to result in irregular, or misplaced end sections. In the preferred embodiment, the thin wall sections 42 extend from approximately the flange 46 for a length 44 approximately equal to one and a half times the thickness passage length 18 of the lamp housing 12. This length leaves some of the thinned wall section 42 to extend outside of the through passage 16. The portion of the tube 28 without grooves also extends beyond the end of passage 16, which lets the tube 28 deform (bow outwards) in the passage 16, and also somewhat on the outside of the formed passage 16. The grooved portion of the tube 28 once it is deformed or bowed outwards, locks and thereby properly positions the second end 38 to the lamp housing 12. The eyelet 26 is then locked in place, while leaving a passage through it for a lead wire 22, 24. The exterior end 48, the ungrooved portion of the tube 28, can then be crimped inward, locking and thereby properly positioning the electric lead 22. By way of example tube 28 is shown as a circular cylinder, although it may be of any other suitable cross sectional configuration. Although three axially straight grooves are shown, four, five or more grooves may be used and they may have spiral or other axially shapes. It is only important that the grooves allow the tube 28 to radially break or bow outwards on sufficient pressure from the tube ends 36, 38, and still hold the flange 46 to the lamp housing 12, while providing a through passage for the electric lead 22.

The flange 46 may be made as an extension of the tube, and thereby made of the same material to have the general form of an annulus, or flared end extended radially from the tube 28. By way of example flange 46 is shown as an annulus, although it may be of any other suitable cross sectional configuration.

The electric coupling 30 may be made out of conductive metal and insulating pieces to have for example the general form of a common threaded base. The electric coupling 30 may have a threaded base, a center contact, and insulating glass gob positioned in between. One lead 22 from the lamp capsule 14 may extend through an eyelet 26 to electrically couple with the center contact, and a second lead 24 extends through a similarly formed second eyelet to electrically couple to the threaded base contact. Any other suitable coupling base configuration may be appropriate.

In a working example some of the dimensions were approximately as follows: The tube was made of 80/20 brass, and had a metal wall. The eyelet was 13.34 millimeters (0.525 inch) long. The eyelet had an outside diameter of 2.79 millimeters (0.11 inch), and an inside diameter of 2.24 millimeters (0.086 inch) giving a thickness of about 0.55 millimeters. One end of the eyelet had a flange with an outside diameter of 4.75 millimeters (0.187 inch). There was a rounded interface between the flange and the main body of the tube, the interface having a radius of curvature of 1.0 millimeters (0.04 inch). Formed on the inside of the tube were three cuts or thinned wall sections extending axially from flange end of the tube for 6.99 millimeters (0.276 inch), approximately half the length of the tube. This distance corresponded to approximately the wall thickness of the lamp reflector the eyelets were to be used in. The remaining distance (unthinned, or unsplit exterior end), allowed sufficient material to form a crimp with the electric lead 22, 24. The three thinned wall grooves were located inside of the tube with approximately equal distances separating them, that is with about 120 degrees spacing between. The thinned wall sections had an indentation depth of from 0.1 to 0.15 millimeters (0.004 to 0.006 inch), or about 18 to 27 percent of the wall thickness. The flange was made as an extension of the tube, and therefore of the same material. The lamp housing was made of glass, and had a wall defining an enclosure wall defining at least one passage from the enclosure to the exterior with a diameter of 3.5 millimeters (0.140 inch). The lamp capsule was made of glass envelope, and had a light source, an envelope, two or more electric leads with diameters of 1.25 millimeters (0.05 inch). The electric coupling was made of conductive metal, and had threaded base, a center contact, and a insulating glass gob positioned between the threaded base and the center contact.

The split eyelet is inserted in a passage formed in the lamp reflector or other lamp housing element. A staking tool is inserted in the eyelet, and the eyelet is then deformed, or bowed outwards in the thinned region by pressing on each end of the tube. The thinned wall portion bows out, pressing against the passage wall of the lamp housing. The pressure of the bowing eyelet can only achieve a limited level before the weakened zones or slits allow the eyelet tube wall to distort or fail. The wall distortion allows the wall sections to buckle or ride over each other. This buckling also provides thermal expansion and contraction of the eyelet with respect to the lamp to be relieved. The crimping process nonetheless forces the flange into tight abutment against the lamp housing wall. The eyelet is then tightly bound in the proper position, but the binding does not fracture, and leaves little or no residual stress in the housing wall that could result in a fracture of the glass lamp housing. The staking tool is withdrawn, and the lamp leads are then threaded through the openings through the eyelets. The lamp capsule is then properly positioned with respect to the lamp housing, and the eyelet, and lamp lead are locked one to the other by crimping the exterior eyelet end to the lamp lead. The eyelet could also be soldered to the electric lead to substantially seal the housing passage, thereby preventing the flow of water or other materials in the lamp housing. Soldering is less preferred due to changing environmental concerns. The lamp leads are then joined to an electrical coupling structure, commonly a standard threaded base, but it could be a bayonet base, pin, plug, or other electrical coupling structure as known in the art.

The design disclosed here incorporates three axial "slits" or thin spots along the walls of the main part of the eyelet. The slits create weak spots in the metal wall of the eyelet. These weak spots distort, or tear as the eyelet tightens up during the riveting process. The weak points then release high point loads and other stresses between the eyelet and the glass. The weak points allow the eyelet crimping equipment to run at higher loads, which are required to produce consistently tight eyelets, with reduced levels of broken glass. After running comparison tests on the production equipment, it was found that the standard eyelet caused a noticeable amount of broken glassware. This was substantially eliminated in switching to the new eyelet design. Product was also wasted due to loose eyelets that moved when the lead wires were welded. Again the new design eliminated the problem. Both types of product waste were lower in the test groups for the new eyelet than in the control groups with the standard (straight tube) eyelet. The reduction in broken glass is indicative of more consistently tight eyelets with less damaged glass. A higher percentage of lamps survive the manufacturing process, and having fewer cracks or other rivet induced defects in final products. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A lamp eyelet comprising:

a) a tube defined by metal wall with a first thickness, the tube having a first end and a second end and having an axis extending between the first end and the second end, b) a flange formed on the first end of the tube, c) a thin walled portion with a second thickness less than the first thickness, the thin walled portion formed along the wall between the first end and the second end, and extending in the axial direction between the first end and the second end, and d) an exterior portion formed between the thin walled portion and the second end.

2. The apparatus in claim 1, wherein the second thickness is zero whereby the wall is formed with a penetration through the tube wall.

3. The apparatus in claim 1, wherein the first tube wall thickness is the same as the flange thickness.

4. The apparatus in claim 1, wherein at least one axially extending thin wall portion zero whereby the wall is formed with a penetration through the tube wall.

5. The apparatus in claim 1, wherein the flange has an outside diameter approximately twice the inside diameter of the tube.

6. The apparatus in claim 1, wherein the there are at least three axially extending thin wall portions.

7. The apparatus in claim 1, wherein at least one axially extending thin wall portion has a zero whereby the wall is formed with a penetration through the tube wall.

8. The apparatus in claim 1, wherein the flange has an outside diameter approximately twice the inside diameter of the tube.

9. The apparatus in claim 1, wherein the there are at least three axially extending thin wall portions.

10. A lamp eyelet comprising:

a) a tube defined by a metal wall, the tube having a first end, a second end, and an axis extending from the first end to the second end, the wall having a first wall thickness, and at least one axially extending thin wall portion having a second thickness less than the first thickness, and a b) a flange, extending radially from the first end of the tube.

11. A lamp comprising a) a lamp capsule having two extending in input leads b) a lamp housing enclosing the lamp capsule, the housing having at least one housing wall defining a through passage to receive an electrical coupling for at least one of the lamp leads, c) eyelet located in the through passage and locked to the lamp housing, the eyelet having i) a tube having a metal wall, the tube having a first end, a second end, an axis extending from the first end to the second end, a first wall thickness, and at least one axially extending thin wall portion with a second wall thickness less than the first wall thickness, an inside diameter, a portion of the wall adjacent the thin walled portion being bowed outward to press against the housing wall, and ii) a flange, extending radially from the first end of the tube, the flange positioned adjacent the housing wall, d) an input lead passing through the tube, and mechanically coupled to the tube to lock the lead in place with reference to the eyelet, and e) an electrical coupling receiving the electrical leads for electrical connection to an electrical supply.

12. The apparatus in claim 11, wherein the thin wall portion has a zero whereby the wall is formed with a penetration through the tube wall.

13. The apparatus in claim 12, wherein the first tube wall thickness is the same as the flange thickness.

* * * * *